US010096948B2

(12) United States Patent
Yu et al.

(10) Patent No.: US 10,096,948 B2
(45) Date of Patent: Oct. 9, 2018

(54) ELECTRICAL CONNECTOR HAVING A SHIELDING SHELL WITH MOUNTING DEVICE AND A FIXING PLATE WELDED TO THE SHIELDING SHELL INTERNALLY

(71) Applicant: FOXCONN INTERCONNECT TECHNOLOGY LIMITED, Grand Cayman (KY)

(72) Inventors: Yang-Yang Yu, Huaian (CN); Jin-Guo Qiu, Huaian (CN); Shao-Cong Zhou, Huaian (CN); Jun Zhao, Huaian (CN)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 15/835,421

(22) Filed: Dec. 7, 2017

(65) Prior Publication Data

US 2018/0159277 A1 Jun. 7, 2018

(30) Foreign Application Priority Data

Dec. 7, 2016 (CN) ..... 2016 1 1114196
Dec. 30, 2016 (CN) ..... 2016 2 1492129 U

(51) Int. Cl.

| | |
|---|---|
| ***H01R 13/52*** | (2006.01) |
| ***H01R 13/6581*** | (2011.01) |
| ***H01R 24/60*** | (2011.01) |
| ***H01R 13/73*** | (2006.01) |
| *H01R 107/00* | (2006.01) |

(52) U.S. Cl.

CPC ..... *H01R 13/6581* (2013.01); *H01R 13/73* (2013.01); *H01R 24/60* (2013.01); *H01R 2107/00* (2013.01)

(58) Field of Classification Search

CPC ..... H01R 13/52; H01R 13/5202; H01R 13/5221; H01R 13/5219; H01R 13/6593
USPC ..... 439/271, 587, 79, 607.35
See application file for complete search history.

(56) References Cited

U.S. PATENT DOCUMENTS

| | | | | |
|---|---|---|---|---|
| 9,634,425 | B1 * | 4/2017 | Hsu | H01R 13/5202 |
| 2014/0302709 | A1 * | 10/2014 | Zhao | H01R 12/57 439/519 |
| 2015/0194761 | A1 * | 7/2015 | Xie | H01R 13/5219 439/521 |
| 2015/0325944 | A1 | 11/2015 | Chien | |
| 2016/0033198 | A1 * | 2/2016 | Hsiao | F26B 3/28 439/485 |

FOREIGN PATENT DOCUMENTS

| | | |
|---|---|---|
| CN | 204118373 | 1/2015 |
| TW | I549388 | 9/2016 |

* cited by examiner

*Primary Examiner* — Hien Vu
(74) *Attorney, Agent, or Firm* — Wei Te Chung; Ming Chieh Chang

(57) ABSTRACT

An electrical connector includes: an insulative housing having a base and a frontal tongue, the base having a front face; an upper and lower rows of contacts mounted in the insulative housing and exposed respectively to two opposite sides of the tongue; a shielding shell enclosing the insulative housing and having a protruding wall (44) abutting the front face of the insulative housing base; and a fixing plate (6) received inside the shielding shell and welded to the protruding wall.

8 Claims, 16 Drawing Sheets

ELECTRICAL CONNECTOR HAVING A SHIELDING SHELL WITH MOUNTING DEVICE AND A FIXING PLATE WELDED TO THE SHIELDING SHELL INTERNALLY

BACKGROUND OF THE INVENTION

1. Field of the Invention

The present invention relates to an electrical connector having a contact module, a shielding shell enclosing the contact module and a fixing plate welded to an interior of the shielding shell with an insulative housing base of the contact module positioned between the shielding shell and the fixing plate.

2. Description of Related Arts

Taiwan Patent No. 549388 discloses an electrical connector including a contact module, s shielding shell enclosing the contact module, and a rear shielding plate secured fixed to an insulative housing of the contact module or welded externally to the shielding shell.

SUMMARY OF THE INVENTION

An electrical connector comprises: an insulative housing having a base and a frontal tongue, the base having a front face; an upper and lower rows of contacts mounted in the insulative housing and exposed respectively to two opposite sides of the tongue; a shielding shell enclosing the insulative housing and having a protruding wall abutting the front face of the insulative housing base; and a fixing plate received inside the shielding shell and welded to the protruding wall.

DETAILED DESCRIPTION OF THE PREFERRED EMBODIMENTS

Figure 1:
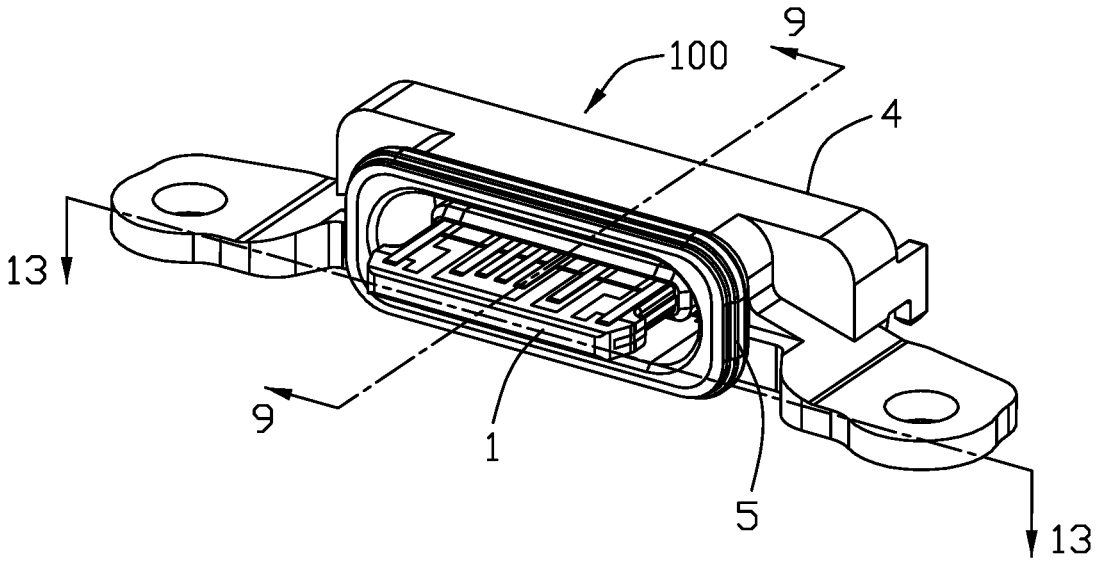
FIG. 1 is a perspective view of an electrical connector in accordance with a first embodiment of the present invention.
Figure 2:
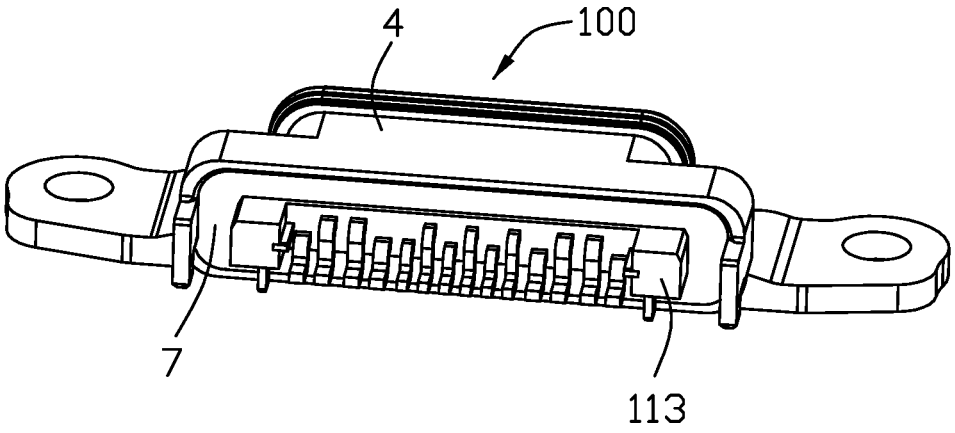
FIG. 2 is a perspective view of the electrical connector from a different perspective.
Figure 3:
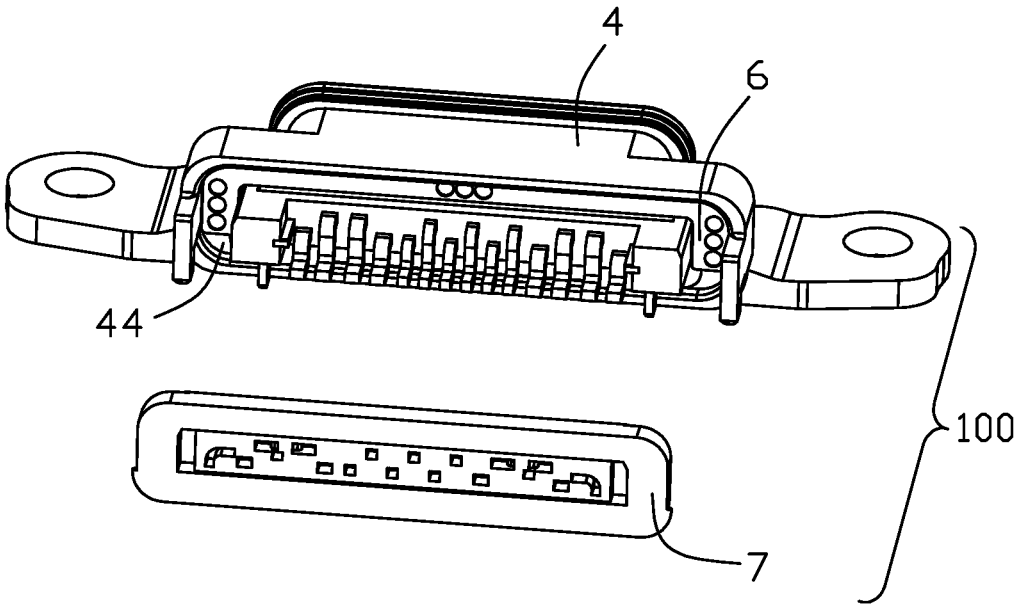
FIG. 3 is an exploded view of FIG. 2.
Figure 4:
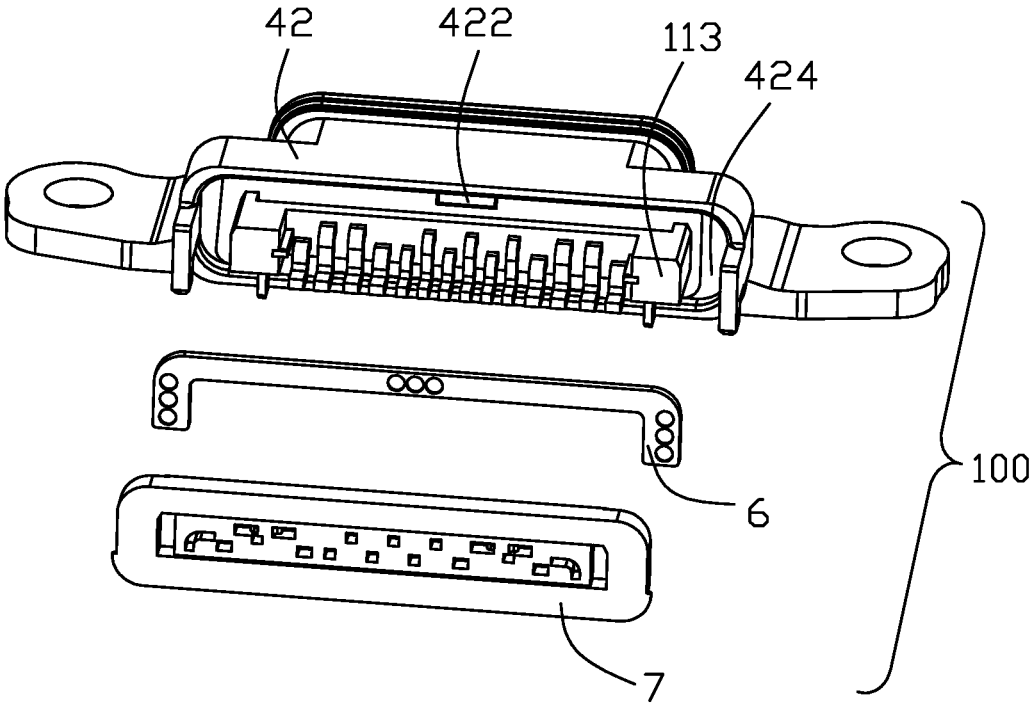
FIG. 4 is a further exploded view of FIG. 2.
Figure 5:
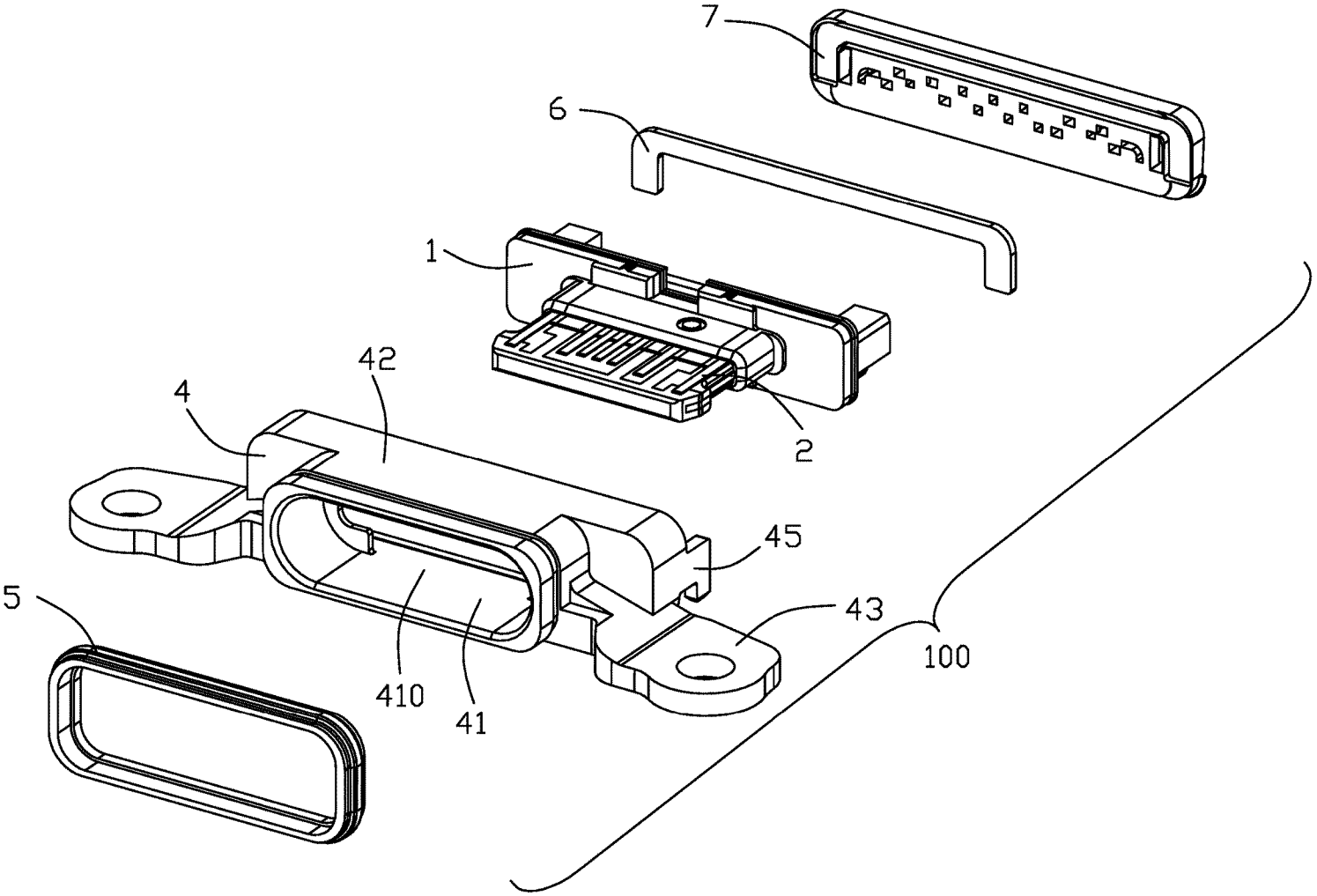
FIG. 5 is an exploded view of FIG. 1.
Figure 5A:
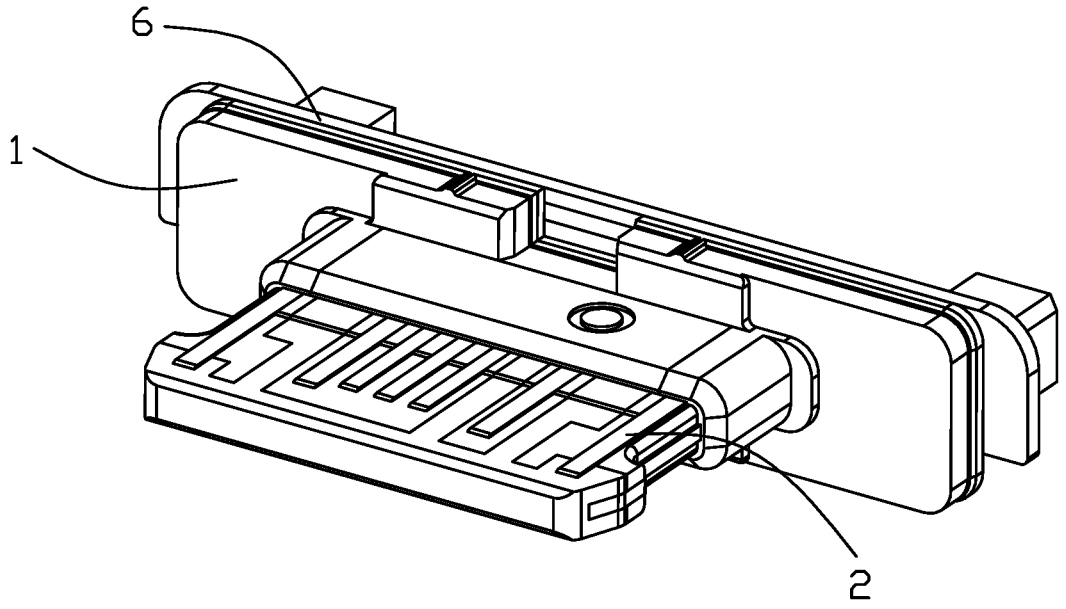
FIG. 5(A) is a perspective view of the contact module with the fixing plate to show how the fixing plate forwardly abuts against the contact housing.

Referring to FIGS. 1-9 and 12, an electrical connector 100 comprises an insulative housing 1 which may be deemed to include along a front-to-back direction a rear base (not labeled) and a front tongue (not labeled), an upper and lower rows of contacts 2 and a pair of metal pieces 3 mounted in the insulative housing 1 to commonly form a contact module (not labeled), a shielding shell 4 enclosing the insulative housing 1, and a fixing plate 6 welded to the shielding shell 4. The pair of metal pieces 3 are located between the upper and lower rows of contacts 2. The electrical connector further includes a front sealing element 5, and a rear sealing element 7.

Figure 6:
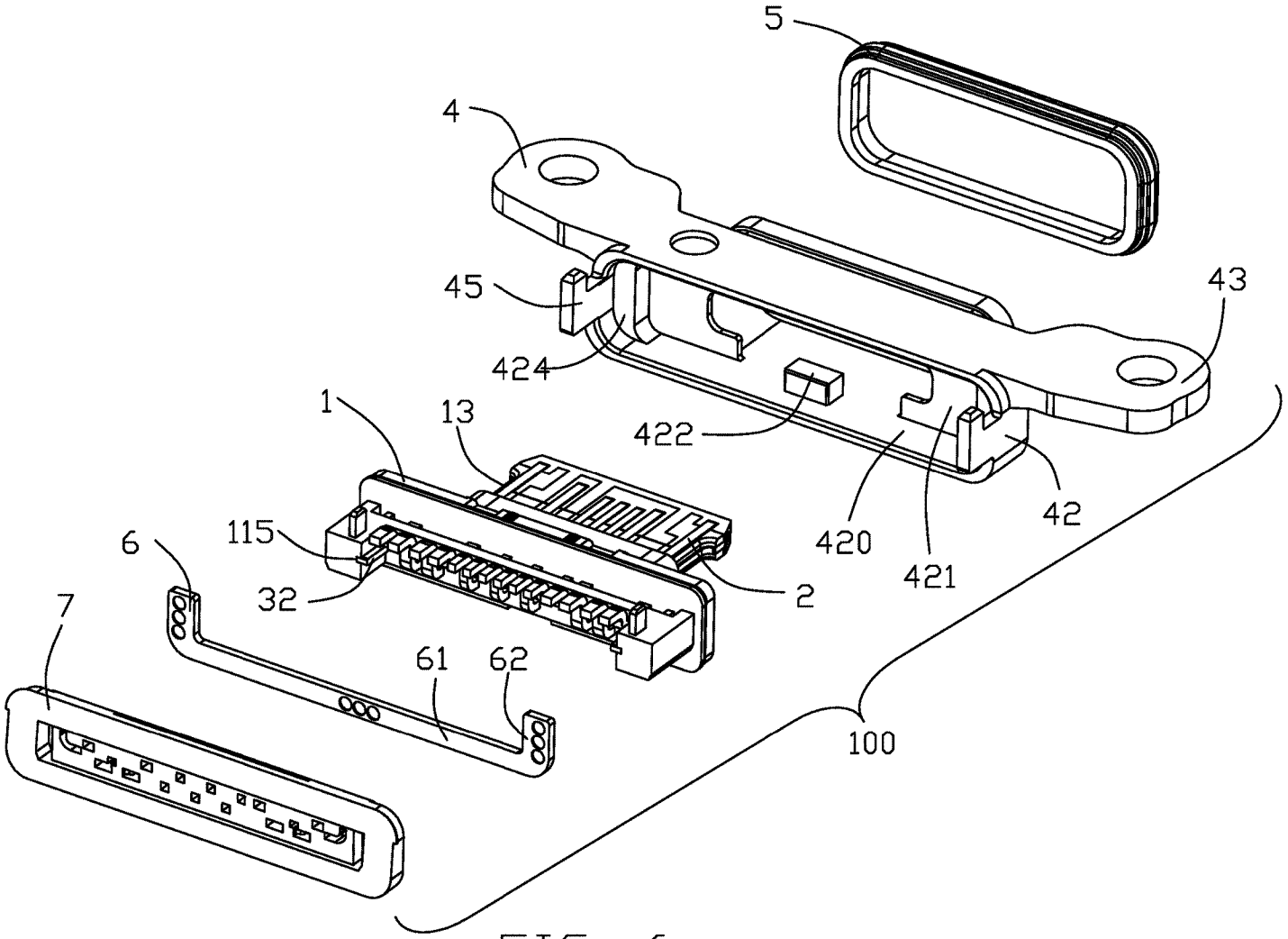
FIG. 6 is a view similar to FIG. 5 but from a different perspective.
Figure 7:
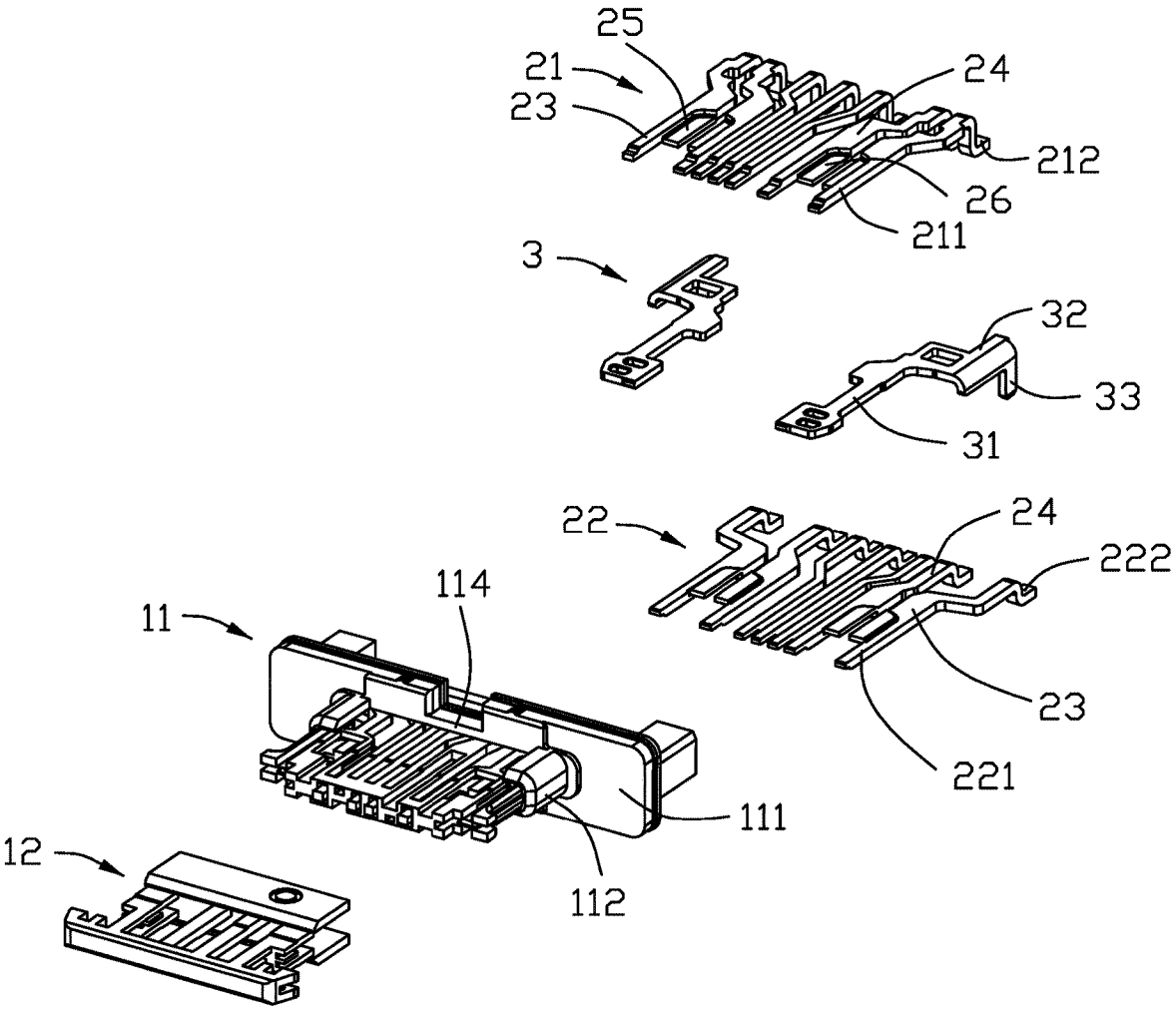
FIG. 7 is an exploded view of an insulative housing and a plurality of contacts of the electrical connector.
Figure 8:
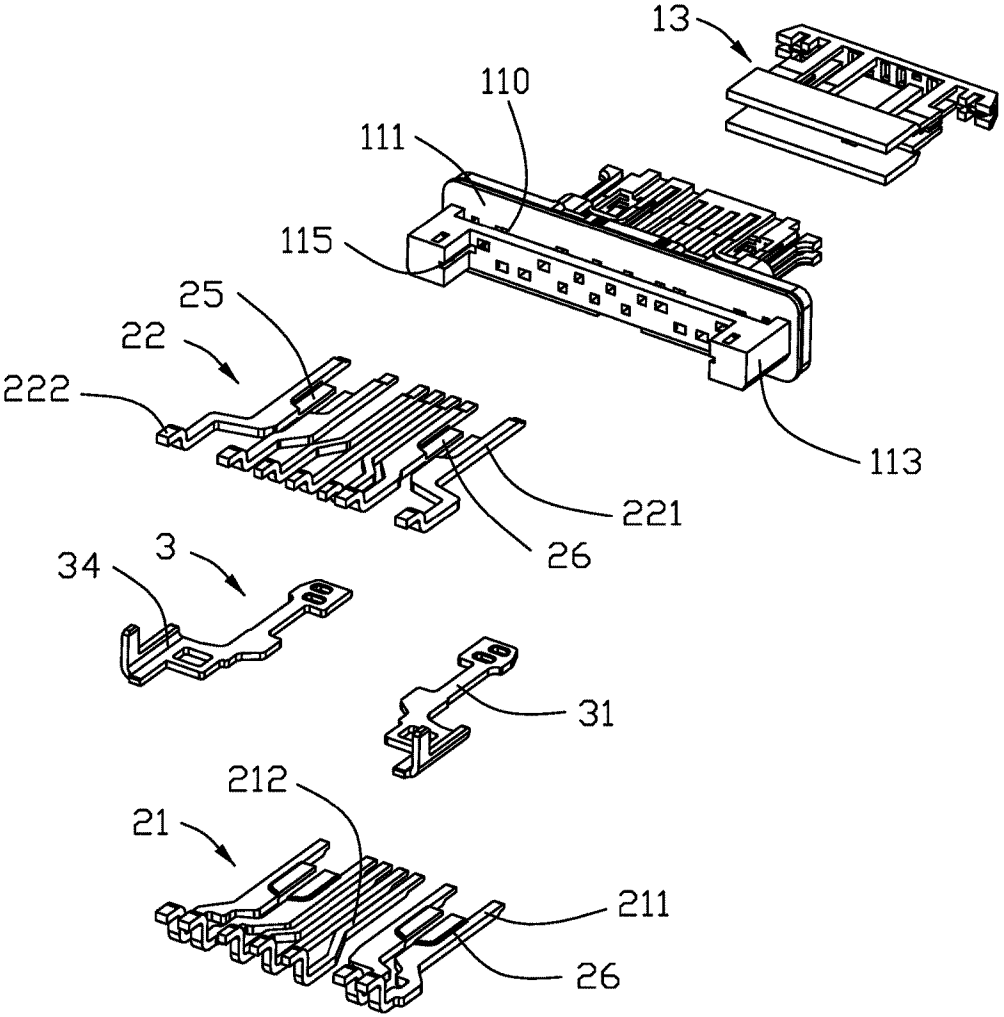
FIG. 8 is a view similar to FIG. 7 but from a different perspective.
Figure 9:
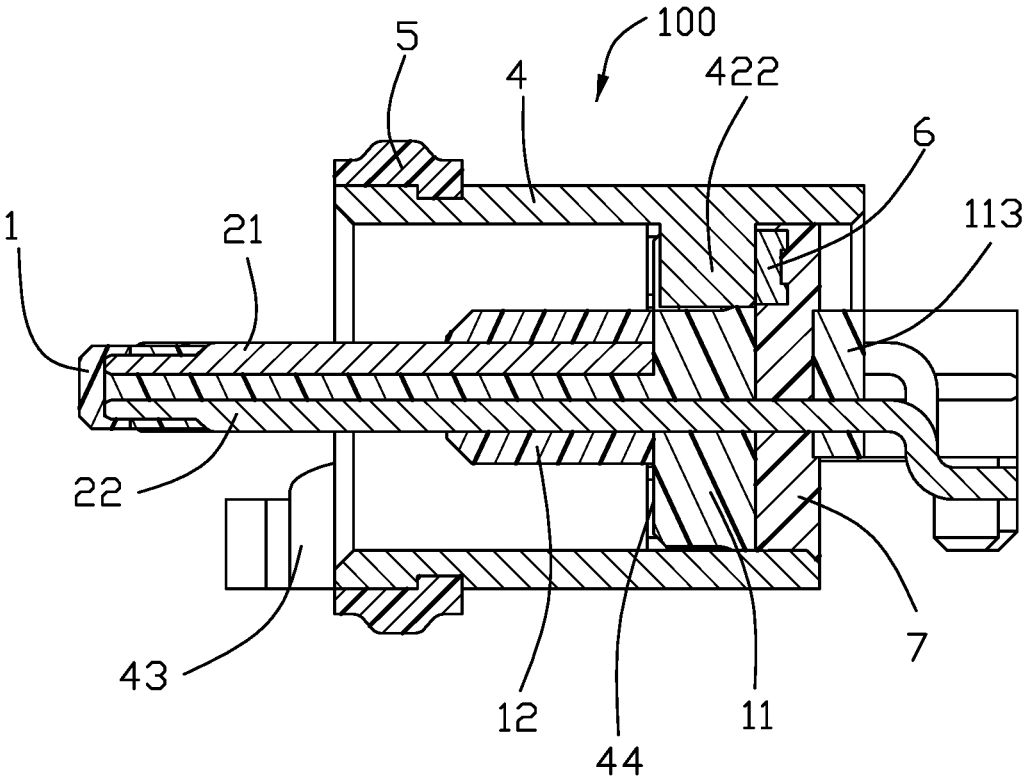
FIG. 9 is a cross-sectional view of the electrical connector taken along line A-A in FIG. 1.

Referring specifically to FIGS. 6-8, the insulative housing 1 includes a first body 11 and a second body 12 overmolding the first body 11. The first body 11 has a base portion 111 and a tongue portion 112. The base portion 111 has a pair of side supports 113 and a middle slot 114. The support 113 shows a groove 115 at an inner side thereof. The insulative housing 1 shows two side recesses 13.

The upper and lower rows of contacts 21 and 22 opposite to each other in a vertical direction, are secured to the first body 11 and are arranged reversely-symmetrically for dual-orientation mating with a complementary connector. Each row of contacts include two outermost ground contacts 23, two adjacent power contacts 24, two signal contacts, and one control contact.

The contact 21 has a contacting portion/section 211 and a soldering portion/section 212; the contact 22 has a contacting portion 221 and a soldering portion 222. Both the ground contact 23 and the power contact 24 are widened. Widened portion 25 of the contacting portion 211 or 221 is buried in the insulative housing 1 and has a reduced thickness. A step 26 is formed around the widened portion 25. Corresponding widened portions 25 of the upper and lower rows of contacts are in touch with each other.

Referring specifically to FIGS. 7-8, the pair of metal pieces 3 commonly deemed as a shielding plate, are disposed at two opposite sides of the insulative housing 1. The metal piece 3 has a main part 31, a supporting part 32 located in the groove 115 of the side support 113, and a leg 33. The main part 31 has a protruding portion 311. The supporting part 32 has a curved portion 34. Notably, the main part 31 forms a locking notch (not labeled) exposed to an exterior in a transverse direction for engagement with a corresponding latch of a complementary connector (not shown).

Referring again to FIGS. 1-6 and 9, the shielding shell 4 includes a first tubular part 41, a second tubular part 42, and a pair of side wings 43. The first tubular part 41 has a receiving space 410 and the second tubular part 42 has a receiving space 420 smaller than the space 410. At the junction of the first part 41 and the second part 42 is disposed a protruding/dividing wall 44 separating the two receiving spaces 410 and 420. The protruding wall 44 has a surrounding wall part 421 profiled to accommodate a tongue of the insulative housing 1, a pair of side protrusions 424 disposed outwardly of two opposite sides of a base of the insulative housing 1, and a middle protrusion 422 protruding into the slot 114 of the base portion 111. A front face of the insulative housing base abuts the wall part 421 of the protruding wall 44. The second tubular part 42 of the shielding shell 4 has a pair of side legs 45. In this embodiment, as shown in FIG.

12 the side wings 43 essentially forwardly and obliquely extends from the second tubular part 42 and are essentially located by and directly face toward two sides of the both the first tubular part 41 and the tongue of the housing in the transverse direction.

The front sealing element 5 is annular and disposed at a front of the first tubular part 41. An outer surface of the element 5 has various ridges for effective water-proof purpose.

Referring again to FIGS. 2-6 and 9, the fixing plate 6 is received inside the second tubular part 42 of the shielding shell 4. The fixing plate 6 has a middle portion 61 and two opposite end portions 62. The fixing plate 6 is substantially U-shaped. The middle portion 61 is spot welded to the middle protrusion 422 and the end portions 62 are spot welded to the side protrusions 424, respectively, thereby firmly mounting the insulative housing 1 to the shielding shell 4. Understandably, only the middle portion 61 welded to the middle protrusion 422 or the end portions 62 welded to the side protrusions 424 is also sufficient for securing the contact module within the shielding shell 4.

Referring again to FIGS. 1-6 and 9, the rear sealing element 7 is formed at a rear of the second tubular part 42 and buries the fixing plate 6. As usual, the sealing element 7 also seals a junction between the insulative housing 1 and the shielding shell 4.

Figure 10:
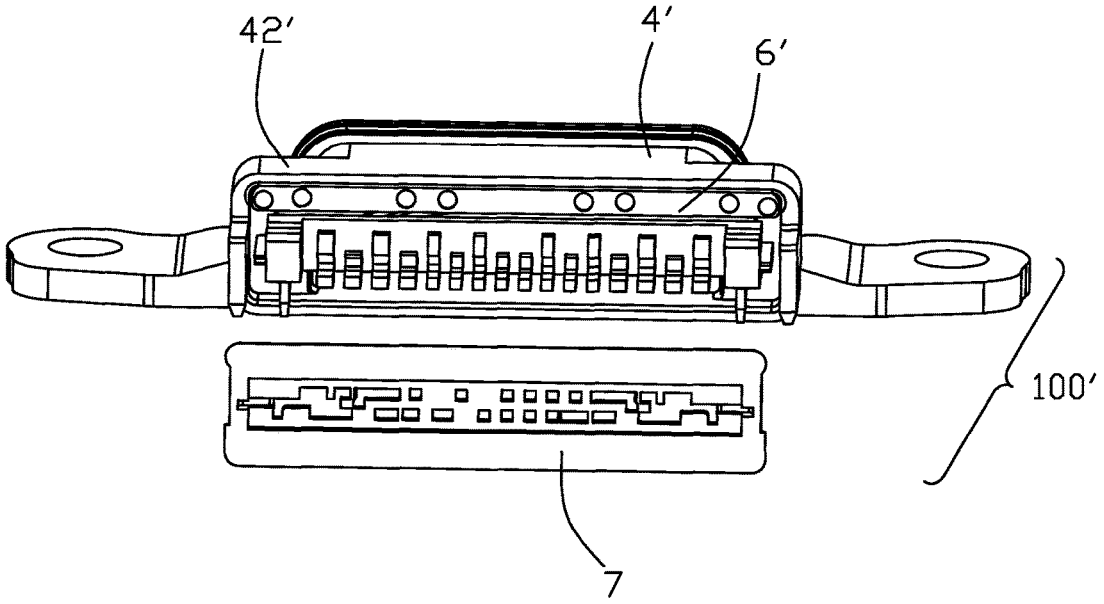
FIG. 10 is a view similar to FIG. 3 but showing an electrical connector in accordance with a second embodiment of the present invention.
Figure 11:
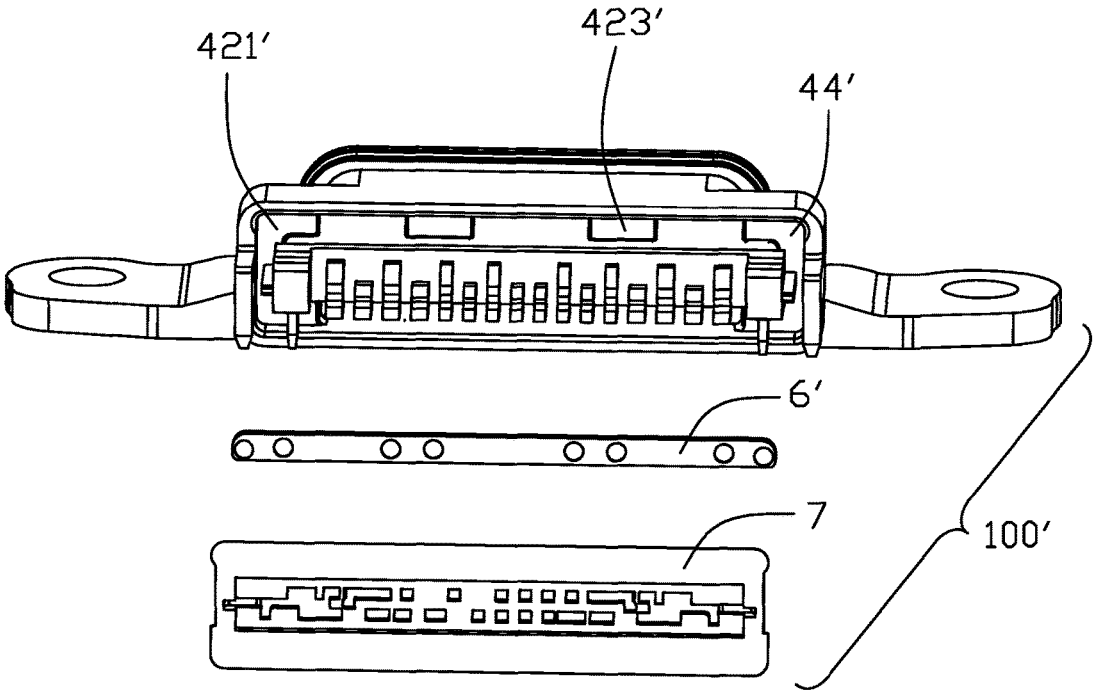
FIG. 11 is a further exploded view of FIG. 10.
Figure 12:
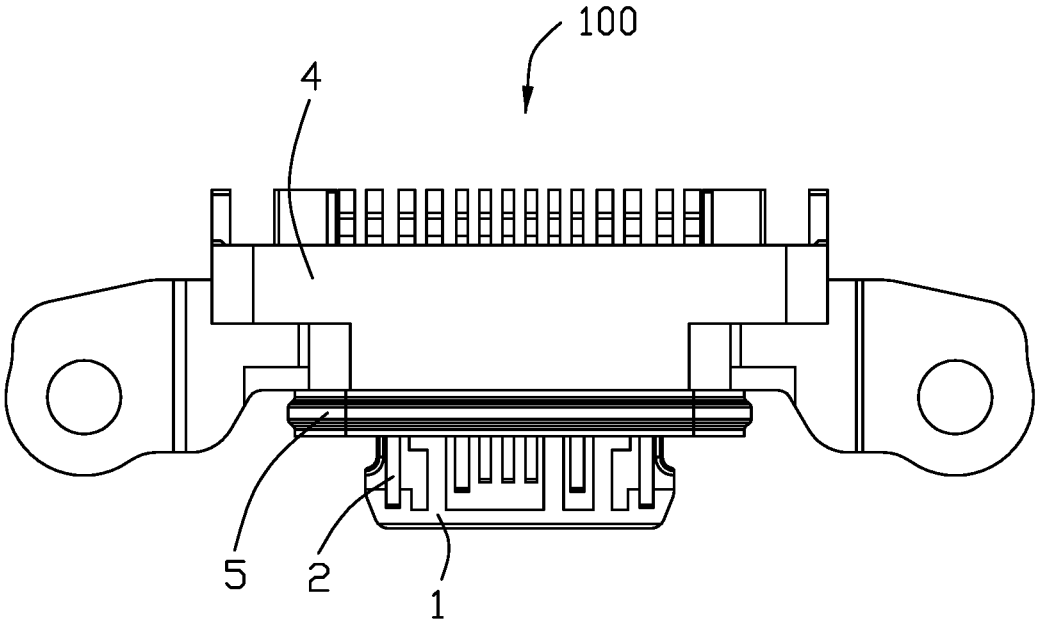
FIG. 12 is a top view of the electrical connector of FIG. 1.
Figure 13:
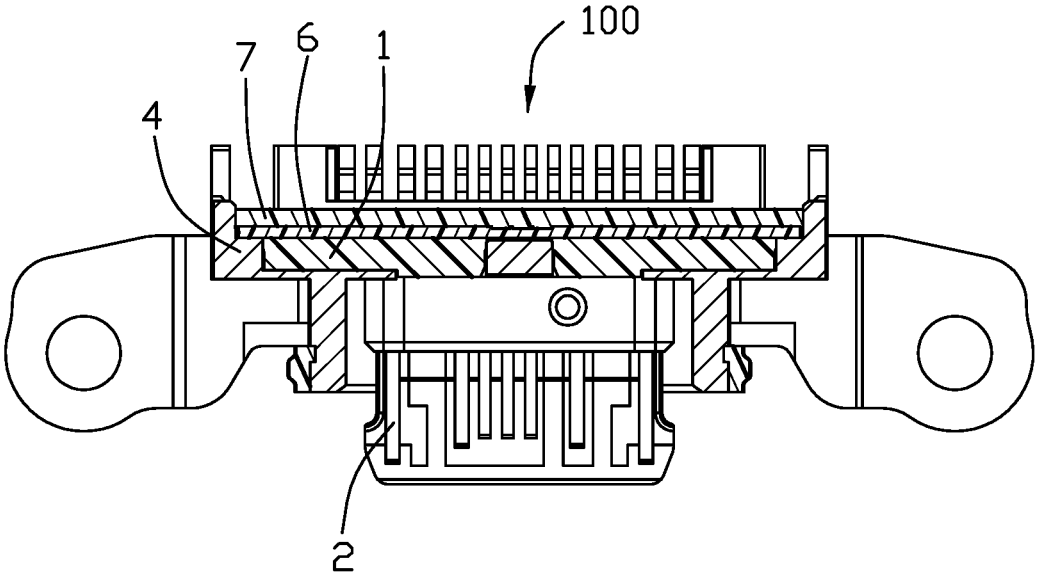
FIG. 13 is a cross-sectional view of the electrical connector of FIG. 1 to show the housing 1 sandwiched between the protruding wall and the fixing plate which is soldered to the side protrusion in a front-to-back direction.

FIGS. 10 and 11 show an electrical connector 100' according to a second embodiment which is different from the electrical connector 100 of the first embodiment only in the fixing plate 6' and the protruding wall 44' of the shielding shell 4. Particularly, the fixing plate 6' is straight, in contrast to U-shaped, and there are two middle protrusions 423'. The two side protrusions 424' have reduced size. Other structures are essentially same and thus will not be repeated here.

Figure 14:
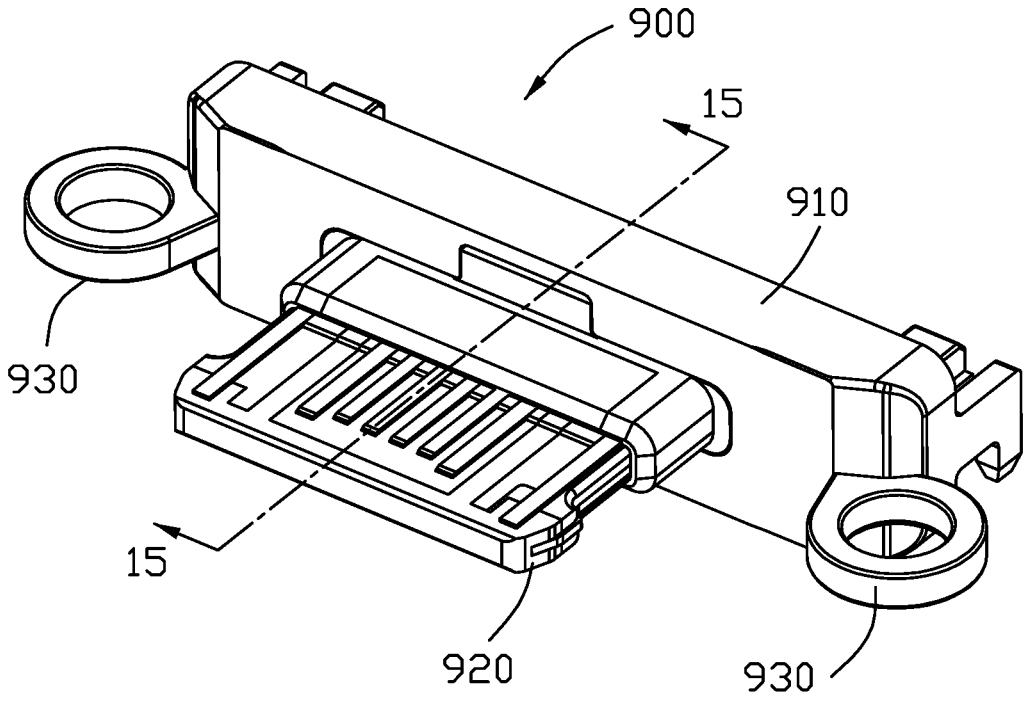
FIG. 14 is a perspective view of an electrical connector of another embodiment according to the invention.
Figure 15:
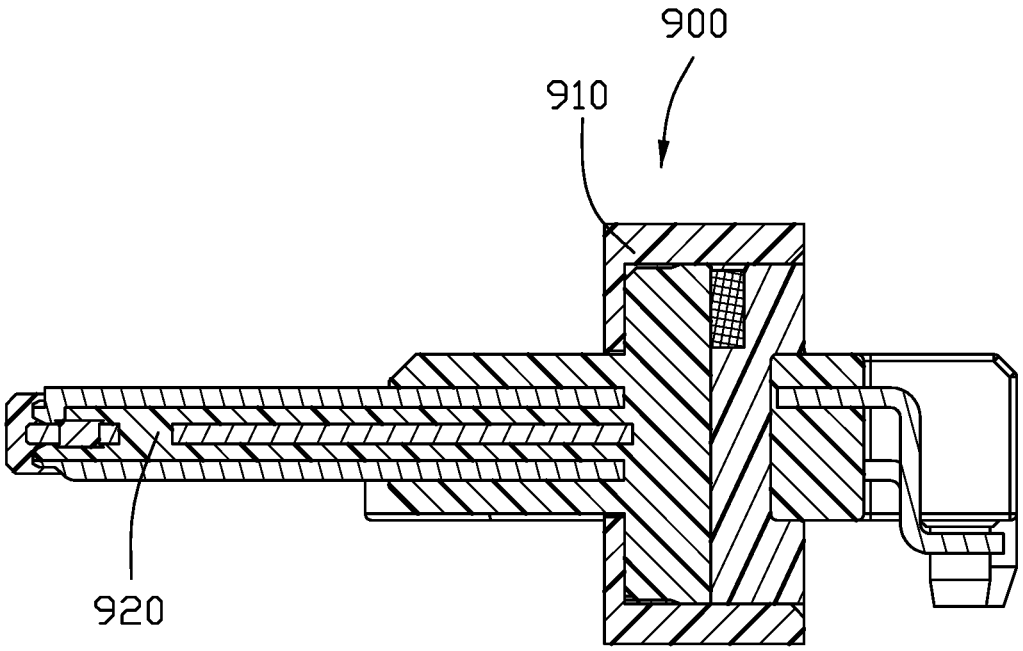
FIG. 15 is a cross-sectional view of the electrical connector of FIG. 14.

FIGS. 14-15 shown another embodiment wherein in the electrical connector 900, the first tubular part of the metallic shell 910 is removed to expose fully the tongue 920, and the side wings 930 directly face the full tongue 920 in the transverse direction. Notably, removal of the first tubular part is to decrease electromagnetic interference between the first tubular part and the contacts.

What is claimed is:

1. An electrical connector comprising:

an insulative housing having a base and a frontal tongue, the base having a front face;

an upper and lower rows of contacts mounted in the insulative housing and exposed respectively to two opposite sides of the tongue;

a shielding shell enclosing the insulative housing and having a protruding wall abutting the front face of the insulative housing base; and a fixing plate received inside the shielding shell and welded to the protruding wall;

wherein the protruding wall comprises an inner wall part profiled to accommodate the insulative housing tongue and a pair of side protrusions in the shielding shell;

the fixing plate spans at least a part of the base and at least a part of the pair of side protrusions; and the fixing plate has two opposite end portions spot welded to the side protrusions so as to have the base secured sandwiched between the protruding wall and the fixing plate;

wherein the pair of side protrusions are disposed on two opposite sides of the insulative housing base;

wherein the protruding wall comprises a middle protrusion, and the fixing plate is spot welded to the middle protrusion and spans at least a part of the insulative housing base; and wherein the insulative housing base has a slot and the middle protrusion protrudes into the slot.

2. The electrical connector as claimed in claim 1, wherein the fixing plate is substantially U-shaped.

3. The electrical connector as claimed in claim 1, wherein the fixing plate is straight.

4. The electrical connector as claimed in claim 1, further comprising a sealing element embedding the fixing plate.

5. An electrical connector comprising:

a contact module including an insulative housing with two rows of contacts and a pair of metal pieces embedded therein, the housing including a rear base and a front tongue defining two opposite surfaces in a vertical direction, each of the contacts including a contacting section exposed upon one of said two opposite surfaces, each of said pair of metal pieces forming a locking notch exposed outwardly in a transverse direction perpendicular to the vertical direction;

a metallic shell enclosing said contact module and unitarily including a protruding wall therein to separate opposite first receiving space and rear receiving space therein wherein the tongue is received in the front receiving space and the base is received in the second receiving space; and a metallic fixing plate soldered to a portion of the protruding wall and forwardly pressing the housing so as to have the base sandwiched between another portion of the protruding wall and the fixing plate in a front-to-back direction perpendicular to said vertical direction and said transverse direction;

wherein said portion of the protruding wall is a surrounding wall part of the protruding wall;

wherein said protruding wall further includes a protrusion extending through the housing in said front-to-back direction, and the fixing plate is soldered to the protrusion;

wherein said protrusion is located around a center region of the housing in the transverse direction; and wherein a rear sealing member is attached behind the fixing plate, and the contact module extends rearwardly through the rear sealing member.

6. The electrical connector as claimed in claim 5, wherein said another portion is a side protrusion of the protruding wall.

7. The electrical connector as claimed in claim 6, wherein said side protrusion is located beside said base in the transverse direction.

8. An electrical connector comprising:

a metallic shell including a protruding wall to separate a front receiving space and a rear receiving space therein in a front-to-back direction;

an insulative housing including a rear base and front tongue extending forwardly from the base along the front-to-back direction, said tongue extending through the protrusion wall and into the front receiving space, a front face of the base forwardly abutting against the protruding wall;

a metallic fixing plate forwardly pressing a rearward surface of the base; wherein said fixing plate is received within the rear receiving space and soldered to the shell so as to have the base secured sandwiched between the protruding wall and the fixing plate in said front-to-back direction;

wherein the fixing plate is soldered to a center protrusion of the protruding wall, and said center protrusion extends through the base in a front-to-back direction;

wherein the fixing plate is soldered to a side protrusion of the protruding wall, and said side protrusion is located beside the base in a transverse direction perpendicular to said front-to-back direction;

wherein said shell further includes a pair of side wings located beside the front tongue in a transverse direction perpendicular to said front-to-back direction; and wherein said pair of side wings extend forwardly and obliquely in a top view.

* * * * *